US006412660B1

(12) United States Patent
Bouix et al.

(10) Patent No.: US 6,412,660 B1
(45) Date of Patent: Jul. 2, 2002

(54) DISPENSING NOZZLE FOR MULTI-COMPARTMENT CONTAINER

(75) Inventors: Herve F. Bouix, New York, NY (US); Adam Sherman, Blackilick, OH (US)

(73) Assignee: E-L Management Corp., New York, NY (US)

( * ) Notice: Subject to any disclaimer, the term of this patent is extended or adjusted under 35 U.S.C. 154(b) by 0 days.

(21) Appl. No.: 09/251,380

(22) Filed: Feb. 17, 1999

(Under 37 CFR 1.47)

(51) Int. Cl.[7] ..... B65D 35/22

(52) U.S. Cl. ..... 222/94; 222/145.5; 222/145.6; 222/541.2; 222/570

(58) Field of Search ..... 222/94, 541.2, 222/212, 145.5, 145.6, 570

(56) References Cited

U.S. PATENT DOCUMENTS

| | | | | |
|---|---|---|---|---|
| 3,206,074 A | * | 9/1965 | Hoffmann | 222/94 |
| 3,441,179 A | * | 4/1969 | Ragan | 222/129 |
| 3,891,125 A | * | 6/1975 | Morane et al. | 222/129 |
| 4,073,406 A | * | 2/1978 | Goncalves | 222/94 |
| 4,099,651 A | * | 7/1978 | Von | 222/94 |
| 4,487,757 A | * | 12/1984 | Kiozpeoplou | 424/7.1 |
| 4,823,946 A | | 4/1989 | Stoeffler et al. | |
| 4,893,729 A | | 1/1990 | Iggulden et al. | |
| 4,898,293 A | | 2/1990 | Morel | |
| 5,076,464 A | * | 12/1991 | Simon | 220/530 |
| 5,102,016 A | | 4/1992 | Ball et al. | |
| 5,263,606 A | | 11/1993 | Dutt et al. | |
| 5,277,303 A | | 1/1994 | Goyet et al. | |
| 5,348,548 A | | 9/1994 | Meyer et al. | |
| 5,482,170 A | | 1/1996 | Semersky et al. | |
| 5,573,143 A | | 11/1996 | Deardurff et al. | |
| 5,765,725 A | | 6/1998 | Matt | |
| 5,921,440 A | * | 7/1999 | Maines | 222/145.2 |

FOREIGN PATENT DOCUMENTS

| | | | | |
|---|---|---|---|---|
| DE | 91 02 636 | | 5/1991 | B65D/35/10 |
| EP | 018725 A1 | * | 5/1986 | B65D/35/24 |
| FR | 2643615 A1 | * | 8/1990 | B65D/81/32 |
| JP | 91/72635 | | 7/1991 | |
| JP | 91/72678 | | 7/1991 | |

* cited by examiner

*Primary Examiner*—Henry C. Yuen
*Assistant Examiner*—Frederick C. Nicolas
(74) *Attorney, Agent, or Firm*—Martin W. Haerter, Esq.; Karen A. Lowney, Esq.

(57) ABSTRACT

A dispensing nozzle for a container having at least two separate compartments and a single neck finish. The dispensing nozzle comprises a hollow shell having an outer surface, an inner surface, a distal end, and a proximal end. At least one partition projects inwardly from the inner surface of the shell, the partitions defining at least two channels within the shell, each channel aligning with a separate compartment of the container. A flange extends radially from the outer surface of the shell, the flange having an upper surface and a lower surface, the lower surface seating against the sealing surface of the container neck. The proximal end of the shell extends beyond the flange and is configured so as to conform to the dimensions of the inner surface of the container neck.

14 Claims, 3 Drawing Sheets

DISPENSING NOZZLE FOR MULTI-COMPARTMENT CONTAINER

FIELD OF THE INVENTION

The present invention relates to containers capable of dispensing more than one product simultaneously. More particularly, it relates to containers which have a single neck finish for dispensing more than one product simultaneously.

BACKGROUND OF THE INVENTION

Multiple component products such as hair dyes, shampoos/conditioners, and treatment products, often require that the multiple components be kept separate until a time just before application. This is because, when mixed, the components react together and have a relatively short stability window. For this reason, various package types have been used in conjunction with these type of products.

One such package type for these multiple component products is one in which each individual component is packaged in a separate container, and then each component is then poured into a separate third container and mixed prior to use by the consumer. The need for these separate containers for each component and a mixing container makes the use of the product time consuming and labor intensive on the part of the consumer.

Another package type, such as that of U.S. Pat. No. 5,277,303, is one in which each component is packaged in a separate container and then the containers are screwed together just prior to use by the consumer. Upon the screwing together of the containers, a sealing strip is pushed out forming an opening between the two containers so that the two components can be mixed together. With these style packages, the consumer is typically required to remove a closure from one of the containers prior to it being screwed onto the other container, and if the consumer does not adequately twist the two containers together, the mixed components could possibly, and very often, leak from the intersection of the two containers.

Further developments, such as that described in U.S. Pat. No. 4,898,293, have provided for a container wherein two bottles, each containing one component of the product, are assembled in a non-detachable manner and an internal mechanism permits the opening of a passage between the two bottles. The passage is closed by a sealing strip or by a heat-sealed film. The disadvantages to this type of package are readily apparent, in that the sealing strip or heat-sealed film has to be perfectly sealed about the passageway so that the two components within each bottle cannot mix together prematurely. Also, the extra step of securing the sealing strip in place and then connecting the bottles together adds to the overall cost of the product, thus making the use of this package more expensive.

A process has been developed where a multiple chamber container having an integral one-piece construction can be molded with only a single neck finish providing access to all compartments. Such a bottle is commercially available from Plastic Technologies Inc., and is described in greater detail in U.S. Pat. Nos. 5,482,170 and 5,573,143, both of which are incorporated herein by reference. Due to this advancement, it is now possible to have multiple component products separated within a single rigid or flexible container and dispensed through the same orifice. Because of molding limitations, however, the type of neck finish on this multiple chamber container is limited. The neck finish must be big enough to accommodate filling machinery so that the products can be filled into their respective compartments, thus making the opening for each compartment fairly large and not particularly suited for dispensing all types of multiple component products.

The present invention provides a dispensing nozzle for a container having multiple compartments and a single neck finish, which nozzle provides for controlled application of a multiple component product.

SUMMARY OF THE INVENTION

The present invention relates to a dispensing nozzle for a container having at least two separate compartments, which container has only a single neck finish. The dispensing nozzle comprises a hollow shell having an outer surface, an inner surface, a distal end, and a proximal end. At least one partition projects inwardly from the inner surface of the shell, said partitions defining at least two channels within the shell, each channel aligning with a separate compartment of the container. A flange extends radially from the outer surface of the shell, said flange having an upper surface and a lower surface, the lower surface seating against the sealing surface of the container neck. The proximal end of the shell extends beyond the flange and is configured so as to conform to the dimensions of the inner surface of the container neck.

In a further embodiment, a collar fits about the neck of the container. The collar has an outer surface, an inner surface, an upper end, and a lower end, the upper end having an inwardly projecting ledge which contacts the upper surface of the flange when the collar is placed on the neck. The collar retains the nozzle in place on the container neck by interacting with a securing means on the outer surface of the container neck.

Additionally, the nozzle can be provided with a twist-off closure at the distal end. The twist-off closure provides a simple means by which the consumer can open each compartment of the container to access the product within.

Further, the nozzle can be provided with a pre-mixing chamber within the shell. The pre-mixing chamber allows the nozzle to be effectively used with products that require mixing before use or application.

BRIEF DESCRIPTION OF THE DRAWINGS

Further objects, features and drawings of the present invention will better be understood in light of the embodiment examples which are discussed below with the aid of a drawing wherein.

DETAILED DESCRIPTION OF THE INVENTION

Figure 1:
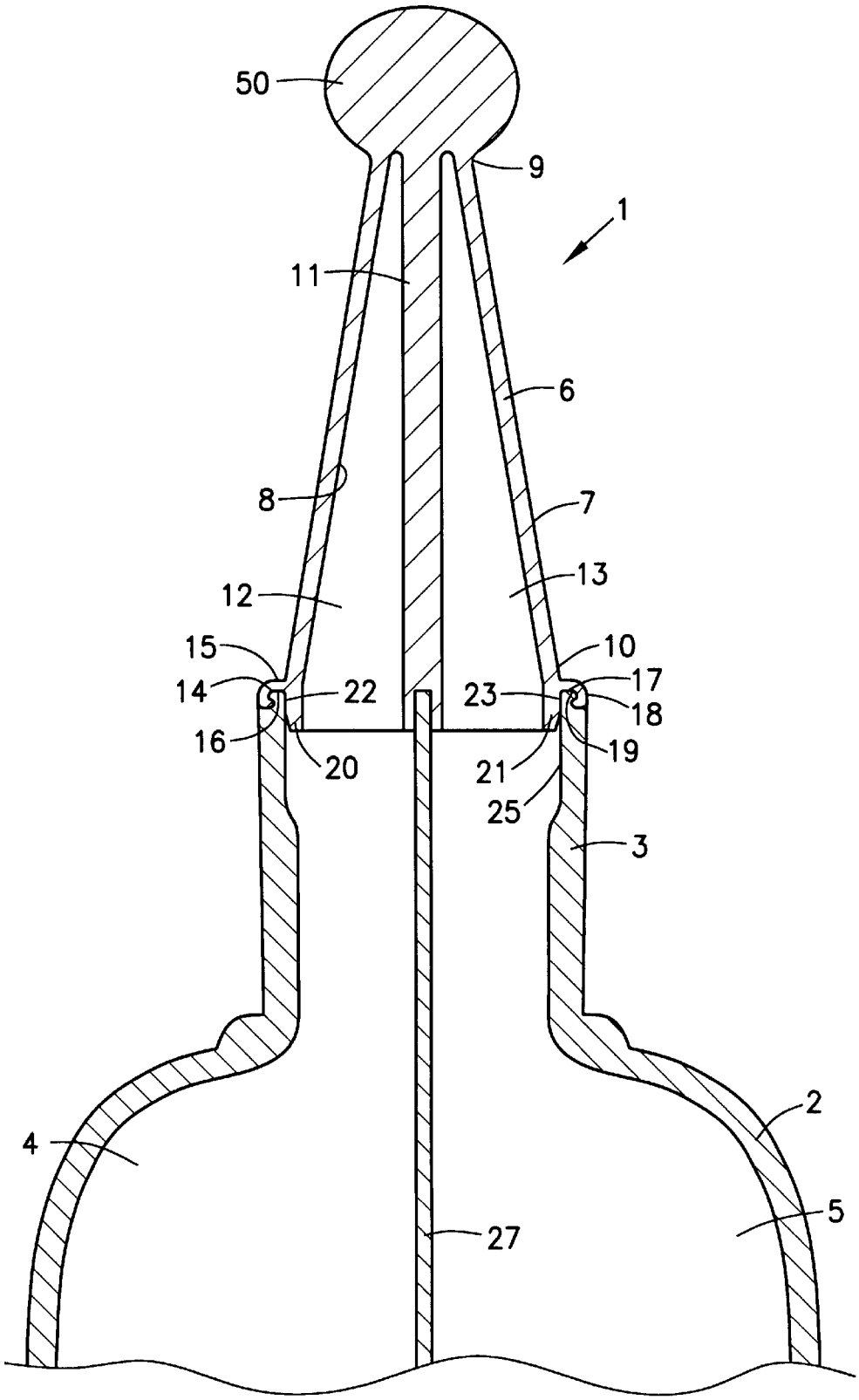
FIG. 1 is a partial cross-sectional view of one embodiment of the present invention wherein the nozzle is snap fit onto the container neck.

FIG. 1 shows one embodiment of the nozzle of the present invention, generally referred to as 1. The nozzle 1 is designed to be mounted on a container 2 having a single neck finish 3. The container contemplated for use with the present invention is a multi-compartment container having a single neck finish, said neck finish providing selective access to each compartment of the container. FIG. 1 shows a container 2 having only two compartments 4 and 5.

Compartments 4 and 5 are separated by a divider 27. Divider 27 extends inwardly from one side of the inner face 25 of the container across the entire internal chamber of the container, so as to divide the internal chamber of the container into two separate and distinct internal compartments 4 and 5. Although FIG. 1 shows a container having two compartments, it is, however, possible for the container to have more than two compartments, i.e., three, four, or more. The method of manufacturing a bottle having a single neck finish and multiple compartments is known in the art and described in U.S. Pat. Nos. 5,482,170 and 5,573,143, both of which are incorporated herein by reference. The changes needed to adapt the present nozzle to a container having more than two compartments will be readily apparent after the following description.

As shown in FIG. 1, the nozzle 1 comprises a hollow shell 6 having an outer surface 7, an inner surface 8, a distal end 9, and a proximal end 10, said shell 6 defining a fluid discharge passage. At least one partition 11 projects inwardly into the fluid discharge passage from the inner surface 8 of the shell 6, said partition 11 defining at least two channels 12, 13 within the shell 6. The channels 12, 13 align with the two or more compartments 4, 5 of the container 2, such that the product within each compartment is kept separate until dispensed from the container 2. For example, as shown in FIG. 1, the nozzle 1 has a single partition 11 which divides the shell into two separate channels 12, 13. Each channel 12, 13 aligns with its respective compartment 4, 5 of the container 2, so that the products within each compartment cannot commingle until dispensed from the container. Although the illustrated example of FIG. 1 shows a nozzle having only two channels, it is possible, and within the scope of the present invention, to have a nozzle with three, four, or more channels.

A flange 14 extends radially from the outer surface 7 of the shell 6. The flange 14 has an upper surface 15 and a lower surface 16, said lower surface 16 configured so as to be able to seat against the sealing surface 17 of the neck 3. As shown in FIG. 1, the flange 14 is designed to cooperate with the sealing surface 17 of the container neck 3. The flange 14 and the sealing surface 17 each have opposing undercuts 18 and 19, respectively, which allow the nozzle 1 to be snap-fit onto the neck 3, thus retaining the nozzle on the neck.

The proximal end 10 of the shell 6 extends beyond the flange 14 and is configured so as to conform to the dimensions of the inner surface 25 of each compartment 4 and 5 at the neck 3 of the container. In other words, and as seen in FIG. 1, the proximal end 10 of the shell extends beyond the flange 14 so as to straddle each partition 27 of the container and form a seal against the inner face 25 of each separate product compartment of the container. Depending on the number of compartments the container has, the dimensions of the proximal end of the shell will vary. For example, as seen in the embodiment of FIG. 1, the proximal end 10 is divided into two half-circle shaped sections 20 and 21. Each section 20 and 21 depends into each separate compartment 4 and 5, respectively, of the container 2. The outer faces 22 and 23 of sections 20 and 21 seal against the inner face 25 of each product compartment 4 and 5. It is desirable to have the seal between the outer faces 22 and 23 and the inner face 25 be of a sufficient integrity that the product contained within each compartment 4 and 5 will not migrate between the outer and inner faces. Typically, a sufficient seal is achieved by providing a friction fit along a line of contact between the nozzle and the container neck. It is well known within the art that the proper dimensioning of the nozzle with respect to the container neck will enable such a seal, and that the tolerances required for a proper seal will depend on the type of product being held within the container compartments. For example, if the products within the container compartments are of a low viscosity, then a higher integrity seal will be required, as compared to products that do not readily flow or which have a large particle size, such as powdered products.

Figure 2:
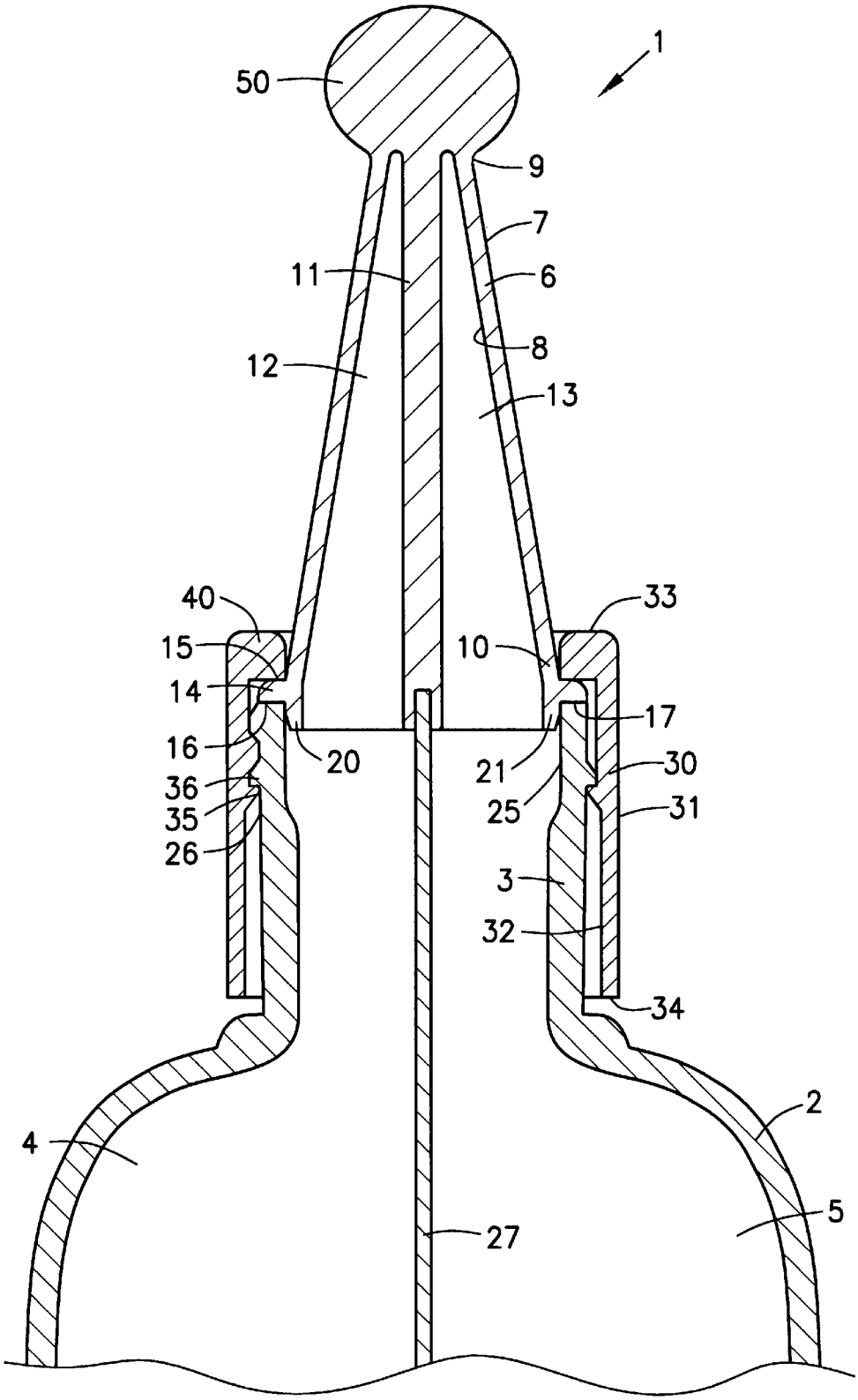
FIG. 2 is a partial cross-sectional view of a second embodiment of the present invention wherein the nozzle has a screw-on collar to attach it to the container neck.

In a further embodiment, as shown in FIG. 2, a collar is secured about the neck of the container to retain the nozzle in place. The collar retains the nozzle in place on the container neck by interacting with a securing means on the outer surface of the container neck. For purposes of simplicity of explanation, the embodiment of FIG. 2 is shown having a threaded finish, and in no way is meant to limit the present invention to threaded finishes. The means by which a collar can be secured onto a neck are known in the art and include such means as a threaded finish, a bayonet-style finish, a snap-on finish, or the like.

The nozzle depicted in FIG. 2 is similar in most respects to the nozzle of FIG. 1, and like numerals will be used to refer to like portions. The nozzle 1 comprises a hollow shell 6 having an outer surface 7, an inner surface 8, a distal end 9, and a proximal end 10, said shell 6 defining a fluid discharge passage. At least one partition 11 projects inwardly into the fluid discharge passage from the inner surface 8 of the shell 6, said partitions 11 defining at least two channels 12, 13 within the shell 6.

A flange 14 extends radially from the outer surface 7 of the shell 6. The flange 14 has an upper surface 15 and a lower surface 16, said lower surface 16 configured so as to be able to seat against the sealing surface 17 of the neck 3. A collar 30 is fitted about the neck 3 of the container 2. The collar 30 has an outer surface 31, an inner surface 32, an upper end 33, and a lower end 34. The inner surface 32 of the collar 30 is provided with a thread 35 which cooperates with the thread 36 located on the outer face 26 of the neck 3 such that the collar 30 can be screwed onto the neck 3. The upper end 33 of the collar 30 has an inwardly projecting ledge 40 which contacts the upper surface 15 of the flange 14 when the collar 30 is screwed onto the neck 3. The contact of the ledge 40 against the upper surface 15 of the flange as the collar 30 is screwed onto the neck 3 acts to secure the shell 6 onto the container neck 3.

The proximal end 10 of the shell 6 extends beyond the flange 14 and is configured so as to conform to the dimensions of the inner surface 25 of the neck 3 of the container. As described in relation to FIG. 1, the proximal end of the shell is dimensioned to seal each container compartment from the other compartments.

Additionally, as shown in FIGS. 1 and 2, the nozzle 1 can be designed such that the shell 6 tapers toward the distal end 9. This design is advantageous when the nozzle is used for precise application of the product within the container. For example, if the product intended for use is a hair dye, then the tapered shell is advantageous because the consumer can position the nozzle over the desired area of application and have a more controlled dispensing of the product through the smaller orifices at the tapered end.

Further, to enable the entire container/nozzle combination to be shipped without having the product spill out through the nozzle, the shell 6 can be closed at the distal end 9. This closure can be such that the consumer has to cut away the end of the shell with a pair of scissors or other sharp instrument in order to open the compartments of the container and access the product. Preferably, however, the distal end 9 of the shell 6 is provided with a twist-off closure 50 which remains intact as the container is shipped, and can be easily removed by the consumer. Twist-off closures are well known in the art, and one such design is provided for in FIGS. 1 and 2.

Figure 3:
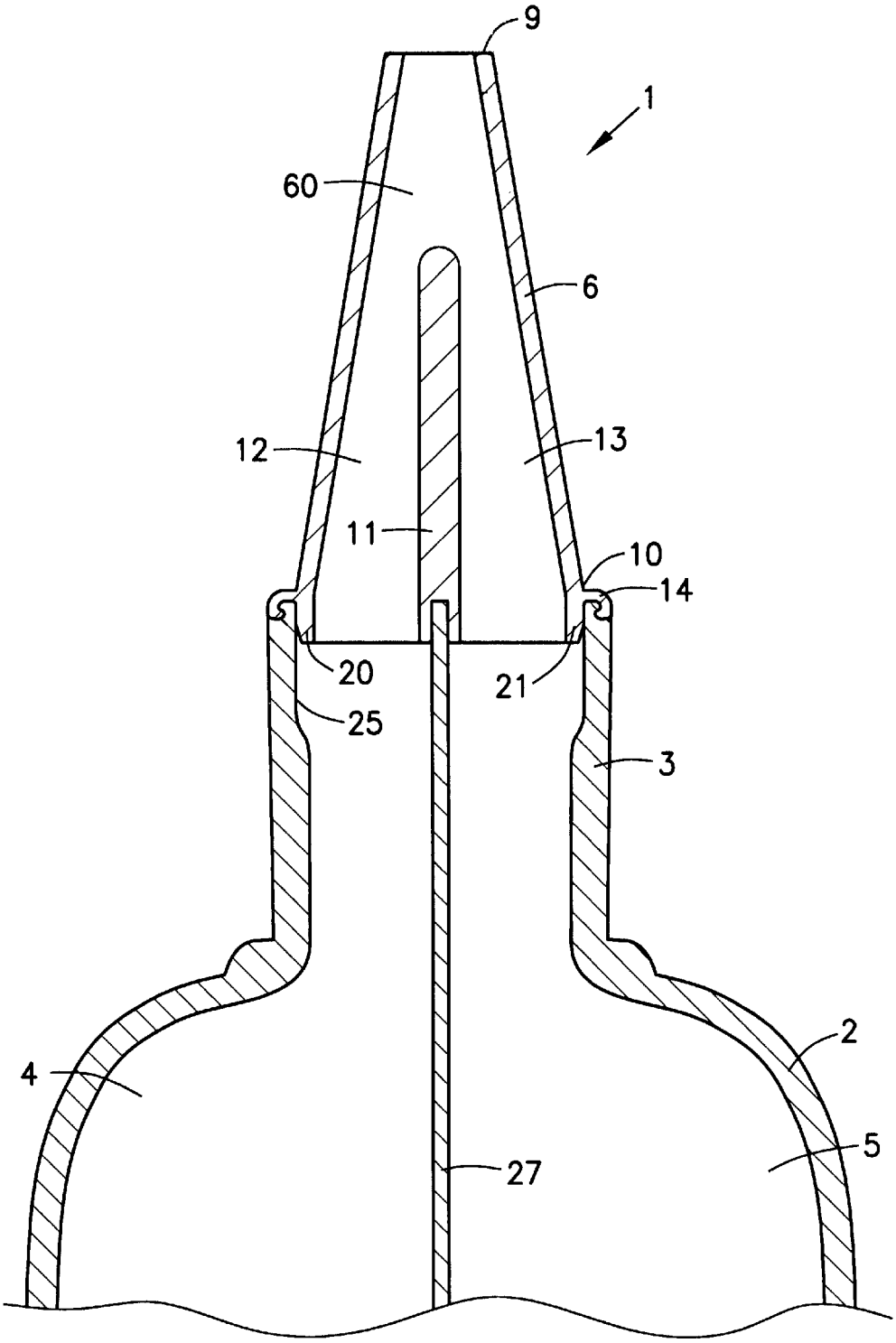
FIG. 3 is a partial cross-sectional view of a further embodiment of the present invention wherein the nozzle contains a pre-mixing chamber.

In a further embodiment, as seen in FIG. 3, the nozzle 1 is designed to have a pre-mixing chamber 60. The pre-mixing chamber 60 is useful for those products which need to be mixed just prior to use, such as, for example, hair dyes, shampoo treatments, or hair conditioners.

To form the pre-mixing chamber 60, the partition 11 within the shell 6 is sized such that it does not extend entirely from the proximal end 10 to the distal end 9 of the shell 6, as in the embodiments of FIGS. 1 and 2. With the embodiment of FIG. 3 the partition 11 stops short of the distal end 9, thereby allowing the channels 12 and 13 of the shell 6 to merge into a single pre-mixing chamber 60, thus allowing the products within each container compartment 4 and 5 to be mixed just before discharge from the container.

Due to the fact that the pre-mixing chamber 60 may permit the products to be mixed before use, the container 2 will need to have a separate seal (not shown in FIG. 3) located between the pre-mixing chamber 60 and the product compartments 4 and 5. The seal can be anything from an adhered label, to an induction sealed cover, to a separate screw-on closure. Such means of sealing a container are known in the art, and will vary depending upon the product intended for use. As will be readily apparent, the nozzle with the pre-mixing chamber 60 will have to be placed on the neck 3 subsequent to the removal of the seal. As with the previously described embodiments of FIGS. 1 and 2, the nozzle having a pre-mixing chamber can be attached to the container neck via a snap-fit, a securing collar, or a standard closure having an aperture which aligns with the pre-mixing chamber to allow the products to be dispensed.

The aforementioned embodiments, and their broader aspects, are not limited to the specific details shown and described; rather, various modifications will be suggested to one skilled in the art, all of which are within the scope of this invention.

What is claimed is:

1. A dispensing nozzle for a container having at least two separate compartments defined by a partition and a single neck, said nozzle comprising:

a hollow shell having an outer surface, an inner surface, a distal end, and a proximal end, said shell defining a fluid discharge passage;

at least one partition projecting inwardly from the inner surface of the shell, said partition defining at least two channels within the shell; and a flange extending from the outer surface of the shell, said flange having an upper surface and a lower surface, said lower surface configured so as to be able to seat against the neck of the container;

wherein the proximal end of the shell extends beyond the flange such that it is adapted to straddle each partition of the container and such that it forms a seal against an inner face of each separate product compartment of the container.

2. The dispensing nozzle of claim 1 wherein a collar is fitted about the neck of the container, said collar having an upper end and a lower end, the upper end having an inwardly projecting ledge which contacts the upper surface of the flange when the collar is placed on the neck.

3. The dispensing nozzle of claim 1 wherein the container neck and the flange each have opposing undercuts which allow the nozzle to be snap-fit onto the neck.

4. The dispensing nozzle of claim 1 wherein the shell tapers toward the distal end.

5. The dispensing nozzle of claim 1 wherein the shell is closed at the distal end.

6. The dispensing nozzle of claim 1 wherein the at least two channels of the shell meet to form a pre-mixing chamber within the shell.

7. The dispensing nozzle of claim 5 wherein the closed end is a twist open closure.

8. A container having at least two separate compartments defined by a partition and a single neck with a dispensing nozzle, each of the at least two compartments having an inner face, said nozzle comprising:

a hollow shell having an outer surface, an inner surface, a distal end, and a proximal end, said shell defining a fluid discharge passage;

at least one partition projecting inwardly from the inner surface of the shell, said partition defining at least two channels within the shell, each channel aligning with a separate compartment of the container; and a flange extending radially from the outer surface of the shell, said flange having an upper surface and a lower surface, said lower surface configured so as to be able to seat against the neck of the container;

wherein the proximal end of the shell extends beyond the flange such that it is adapted to straddle each partition of the container and such that it forms a seal against the inner face of each of the at least two compartments of the container.

9. The container of claim 8 wherein a collar is fitted about the neck of the container, said collar having an upper end and a lower end, the upper end having an inwardly projecting ledge which contacts the upper surface of the flange when the collar is placed on the neck.

10. The container of claim 8 wherein the container neck and the flange each have opposing undercuts which allow the nozzle to be snap-fit onto the neck.

11. The container of claim 8 wherein the shell tapers toward the distal end.

12. The container of claim 8 wherein the shell is closed at the distal end.

13. The container of claim 8 wherein the at least two channels of the shell meet to form a pre-mixing chamber within the shell.

14. The container of claim 12 wherein the closed end is a twist open closure.

* * * * *